US005100485A

United States Patent [19]

Yamashita et al.

[11] Patent Number: 5,100,485

[45] Date of Patent: Mar. 31, 1992

[54] METHOD FOR MANUFACTURING PERMANENT MAGNETS

[75] Inventors: Fumitoshi Yamashita, Ikoma; Masami Wada, Hirakata, both of Japan

[73] Assignee: Matsushita Electric Industrial Co., Ltd., Osaka, Japan

[21] Appl. No.: 465,190

[22] PCT Filed: Jun. 21, 1989

[86] PCT No.: PCT/JP89/00618

§ 371 Date: Feb. 21, 1990

§ 102(e) Date: Feb. 21, 1990

[87] PCT Pub. No.: WO89/12902

PCT Pub. Date: Dec. 28, 1989

[30] Foreign Application Priority Data

| | | | |
|---|---|---|---|
| Sep. 22, 1988 | [JP] | Japan | 63-237611 |
| Sep. 22, 1988 | [JP] | Japan | 63-237612 |
| Jan. 27, 1989 | [JP] | Japan | 1-17979 |
| Jan. 27, 1989 | [JP] | Japan | 1-17980 |
| Jun. 21, 1989 | [JP] | Japan | 63-153268 |

[51] Int. Cl.[5] ..... H01F 41/02

[52] U.S. Cl. ..... 148/101; 148/105

[58] Field of Search ..... 148/101, 105; 75/349

[56] References Cited

U.S. PATENT DOCUMENTS

| | | | |
|---|---|---|---|
| 4,957,668 | 9/1990 | Plackard et al. | 148/101 |
| 4,963,320 | 10/1990 | Saito et al. | 148/101 |

FOREIGN PATENT DOCUMENTS

| | | |
|---|---|---|
| 133758 | 3/1985 | European Pat. Off. . |
| 231620 | 8/1987 | European Pat. Off. . |
| 63-21804 | 1/1988 | Japan . |

OTHER PUBLICATIONS

Patent Abstracts of Japan, vol. 13, No. 453 (E-831)(3801) Oct. 12, 1989, & JP-A-1 175705 (Daido Steel Co. Ltd.), Jul. 12, 1989, *the whole document*.

*Primary Examiner*—R. Dean
*Assistant Examiner*—George Wyszomierski
*Attorney, Agent, or Firm*—Wenderoth, Lind & Ponack

[57] ABSTRACT

A method for manufacturing permanent magnets from a plurality of thin flakes of a rare earth-Fe-B alloy metal, comprising the steps of subjecting the thin flakes to a discharge electric field, the thin flakes being comprised of an R-Fe-B alloy metal; and R-Fe-B-M alloy metal; an R-Fe(CO)-B alloy metal comprising 11 to 18 atom % R, 4 to 11 atom % B, 30 atom % Co, the balance being Fe; and/or an R-Fe(Co)-M-B alloy metal, generating Joule heat on the contacting interfaces of the thin flakes by applying pressure to the gathered body of thin flakes and by supplying a current thereto, and bonding the gathered body integrally by making the thin flakes deform plastically in a warm state.

R is one or more rare earth elements and M is one or more members selected from the group consisting of Si, Al, Nb, Zr, Hf, Mo, Ga, P and C. The thin flakes are in a nonequilibrium state such that the $R_2Fe_{14}B$ phases and amorphous phases are coexistent.

9 Claims, 4 Drawing Sheets

10 μm

10 μm

METHOD FOR MANUFACTURING PERMANENT MAGNETS

FIELD OF THE INVENTION

1. Background of the Invention

The present invention relates to a method for manufacturing permanents magnets of arbitrary shapes using thin flakes of a rare earth-Fe-B alloy metal as a raw material.

2. Description of the Prior Art

Thin flakes of an R-Fe-B alloy metal (R indicates one or more rare earth elements) in a nonequilibrium state, as a raw material, wherein $R_2$-Fe-B phases and amorphous phases are coexistent can be obtained by rapidly quenching an R-Fe-B alloy metal in a melted state at a quenching speed of $10^{4°}$ C./sec or more and thereby, freezing at least a portion of the alloy metal in the melted state as it is. Accordingly, they are obtained only in such a flaky configuration having a thickness of 20 to 30 μm and a length smaller than 20 mm. Therefore, in order to form permanent magnets of arbitrary shapes, it becomes necessary to solidify thin flakes gathered by a predetermined amount using a suitable method.

As solidifying means, there have been known a sintering method for sintering a mass of thin flakes at an ambient pressure and a hot press method wherein a mass of thin flakes is pressed while being heated.

However, the conventional method such as the sintering method or the hot press method has an disadvantage in that the magnetic properties are lowered since $R_2Fe_{14}B$ phases grow too large due to a heating temperature higher than the crystallization temperature of the R-Fe-B alloy metal and a long heating time.

SUMMARY OF THE INVENTION

Accordingly, a main object of the present invention is to provide a manufacturing method capable of forming permanent magnets of arbitrary shapes without lowering the magnetic properties of R-Fe-B alloy metal in the nonequilibrium state wherein $R_2Fe_{14}B$ phases and amorphous phases are coexistent.

The object of the present invention mentioned above is achieved by applying a pressure in an axial direction to a mass of thin flakes made of an R-Fe alloy metal, supplying an electric current thereto to generate Joule heat at contacting interfaces among the flakes and, bonding them into one piece by making them deform plastically at a high temperature. The Joule heat generated by supplying the current is propagated through respective contacting interfaces and particles become easy to deform plastically. Especially, atomic bonding is accelerated regarding atoms locating on the contacting interfaces since they are easily movable as the result of activation. Features of the present method exist in that the thickness of each membrane having a large electric resistance is smaller than several tens nm and in the supply of current and, thereby, in that the contacting interfaces can be bonded by the supply of current for several seconds without accompanying transition of the nonequilibrium state wherein $R_2Fe_{14}B$ phases and amorphous phases are coexistent.

In the meanwhile, it is important and necessary for improving the magnetic properties of the R-Fe-B permanent magnet according to the present invention to promote rearrangement of particles upon bonding of contacting interfaces and to decrease vacancies by pressurizing the mass of particles upon supplying the electric current.

Further, it is desirable to make contacting interfaces among particles and/or between individual particle and a support member breakdown dielectrically by generating a discharge beforehand and, when the discharge is caused once, surfaces of contacting interfaces are cleaned up by impacts by electrons emitted from a cathode and ions generated at an anode. And, impact pressure by the discharge can yield particles distortions to increase the dispersion velocity of atoms. This enables efficient bonding.

LIST OF REFERENCE NUMERALS IN THE DRAWINGS

Figure 1:
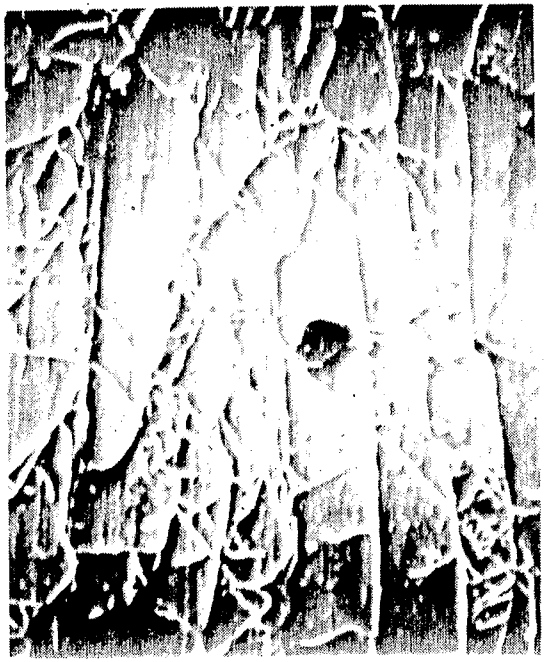
FIG. 1 is a photograph showing a texture of solidified thin flakes of the permanent magnet obtained according to the preferred embodiment of the present invention, FIGS. 2(*a*) and 2(*b*) are photographs showing crystal grains ($R_2Fe_{14}B$ phases) of an original thin flake and the permanent magnet, respectively, FIGS. 3(*a*) and (*b*) are characteristic graphs showing relation among an amount (atomic %) of a rare earth element, the proper coercive force Hcj and the residual magnetic flux density Br.

1 . . . Gathered body of thin flakes of a rare earth-Fe alloy metal;
2 . . . Support member of Fe;
3 . . . die of SiC;
4*a* . . . Punch of WC/Co;
4*b* . . . Punch of SiC;
5*a* . . . Center core of Ni base heat resistive alloy metal;
5*b* . . . Center core of SiC.

DESCRIPTION OF THE PREFERRED EMBODIMENTS

The term "rare earth-Fe thin flake" referred to in the present invention is a rare earth-Fe alloy metal in a nonequilibrium state wherein $R_2Fe(Co)_{14}B$ phases and noncrystalline phases are coexistent and can be obtained, for instance, by quenching it in a hot melted state at a very high quenching speed, for example $10^{4°}$ C./sec to freeze at least a part thereof in a melted state. When the single roll method is employed as a quick quenching means, the rare earth-Fe thin flakes has a thickness from 20 to 30 μm ordinally. Also, in general, grain-size adjustment is done by mechanical grinding.

A maximum value of the proper coercive force Hcj being magnetically isotropic is obtained based on a composition of the alloy metal by conditioning the above rare earth-Fe thin flakes into a texture wherein $R_2Fe(Co)_{14}$ phases of a magnitude of 40 to 400 nm are randomly gathered.

In the meanwhile, the term "conditioning" means to heat the rare earth-Fe thin flakes up to a temperature equal to or higher than the crystallizing temperature of the $R_2Fe(Co)_{14}B$ phase in an inactive atmosphere for example Ar gas or the like and it is possible to manufacture a magnetically anisotropic thin flakes wherein the magnetizing easy axis is oriented in a direction perpendicular to the surface thereof when the warm rolling is employed as the heat treatment. The level of Hcj of this rare earth-Fe thin flake gives a great influence on the substantial thermal stability as a permanent magnet, however, it is desirable to maintain the value of Hcj at a room temperature equal to or larger than 8 KOe and the size of $R_2Fe(Co)_{14}B$ phase at a value of 40 to 400 nm in order to ease factors of the manufacturing conditions, especially restrictions in the heating temperature. The level of the proper coercive force Hcj is fundamentally dependent on the kind of R (R is one or two or more rare earth elements including Y), the amount of R and the size of $R_2Fe(Co)_{14}B$ phase. In order to maintain Hcj equal to or larger than 8 KOe, it is desirable to make R be Nd and/or Pr, the amount of R be a value between 12 and 15 atomic % and the size of $R_2Fe(Co)_{14}B$ phase be of a value between 40 and 400 nm. One or two or more elements are included as substituting and additive elements of the above rare earth-Fe thin flake and further, it is possible to include either one element or a combination of two or more elements selected among Si, Al, Nd, Zr, Hf, Mo, Ga, P and C. Accordingly, from the view point of the composition of the alloy metal forming the rare earth metal-Fe thin flake, there are R-Fe-B, R-Fe(Co)-B, R-Fe-B-M and R-Fe(Co)-B-M alloy metals (wherein R indicates one or two or more rare earth element and M indicates one element or a combination of two or more elements selected among Si, Al, Nd, Zr, Hf, Mo, Ga, P and C and the amount thereof is equal to or less than 3 atomic %).

The term "solidified body of rare earth metal-Fe thin flakes" indicates such a state in that they are directly filled into a cavity of an arbitrary shape defined by electrically conductive punches forming a pair of electrodes and a die forming the cavity.

The term "direct discharge to the solidified body of rare earth metal-Fe thin flakes" used in the present invention indicates to apply a direct current voltage and/or a low frequency voltage between the pair of electrode punches ($0<\omega<<\omega pi$ wherein $\omega$ is a frequency of the voltage, $\omega pi$ is the frequency of an ion plasma) and to generate a discharge plasma in the cavity.

The feature of this discharge exists in that the plasma is maintained by emission of primary electrons from the negative electrode (cathode) when gas molecules or oxidized films adhered to surfaces of the rare earth-Fe thin flakes forming the solidified body in the cavity are removed by ion impacts due to the plasma, respective thin flakes are brought into an activated state, whereby the dispersion of atoms and the plastic deformation tend to be generated easily. It is desirable to keep the atmosphere at a vacuum equal to or lower than 10 Torr in order to lower the operative pressure of the discharge plasma and to suppress surfacial oxidization of the rare earth-Fe thin flake. This is because it becomes difficult to bring the whole of the rare earth-Fe thin flakes forming the solidified body homogeneously into the activated state since concentration of the discharge current is accelerated in an atmosphere of a high pressure since dispersion of plasma particles is suppressed therein.

It is desirable to make application of the pressure of one axis and the current referred to in the present invention at a stage in that surfaces of the rare earth-Fe thin flakes forming the solidified body in the cavity as mentioned above have been activated by the discharge plasma. Joule heat per unit volume of the solidified body of the rare earth-Fe thin flakes is represented by the sum of $Q_B=i^2 \cdot R_B$ ($R_B$ is an electric resistance of the contacting interface between adjacent thin flakes) and $Q_C=i^2 \cdot R_C$ ($R_C$ is an electric resistance of the inside portion of the thin flake). In general, $R_B$ has a level of about 100 times $R_C$ and therefore, if $R_B$ and $R_C$ are assumed to form a circuit in series, $Q_B$ becomes large by about 100 times $Q_C$ and, thereby, only contacting interfaces of the thin flakes are heated mainly.

Accordingly, atomic bonding on the contacting interfaces of the thin flakes activated by the discharge plasma having been generated beforehand is quickly spread over the whole of the solidified body and, at the same time, gaps among the thin flakes are reduced while they are deforming plastically.

As factors for activating the rare earth-Fe thin flakes, 1 pressure in heating 2 ion impact by the discharge and 3 movement of ions are recited and the velocity of the atomic bonding, namely, the dispersion of atoms is represented by an equation $D(\delta^2 n/\delta x^2)+\mu E(\delta n/\delta x)$ (wherein D: dispersion constant, n: number of dispersing particles, xi: position, $\mu$: mobility, E: strength of electric field). Namely, the dispersion constant D is enlarged by an amount of the internal energy increased by the discharge and the plastic deformation and, further, dispersion of the ion electric field acts thereto positively. Accordingly, this is essentially superior to the hot-pressed magnet as a means for solidifying a mass of the rare earth-Fe thin flakes by atomic bonding at a temperature equal to or higher than the crystallizing temperature. Especially, the feature of this manufacturing method is to transfer the gathered body of the rare earth-Fe thin flakes into an activated state by utilizing a direct current (2 electrodes) discharge having been used as a means for generating discharge plasmas and to sinter if resistively thereafter. Accordingly, this enables not only to obtain permanent magnets of the rare earth-Fe having arbitrary shapes very quickly but also to suppress variations of the proper coercive force Hcj and the thermal coefficient thereof since a time needed for heating $R_2Fe(Co)_{14}B$ phase at a temperature equal to or higher than the crystallizing temperature thereof can be shortened greatly and, as the result, to maintain the thermal stability necessary for the permanent magnet.

Further, there is obtained an advantage in that an excellent magnetic property can be obtained since partial magnetic anisotropic property in the direction of pressure axis is enhanced by progress of the plastic deformation. The rare earth-Fe thin flake is desirable to have an average particle size of a value from 53 to 250 $\mu$m. This is because the proper coercive force Hcj of the thin flake is lowered when it is smaller than 53 $\mu$m and, when it is larger than 250 $\mu$m, the resistance of plastic deformation becomes large. Also, the pressure between electrode punches is desirably set at a value from 200 to 250 Kgf/cm$^2$. When it is smaller than 200 Kgf/cm$^2$, the partial magnetic anisotropicalization and high densification by the plastic deformation become insufficient and, therefore, the proper coercive force Hcj is reduced relatively. On the contrary to the above, even if it is set at a value higher than 500 Kgf/cm$^2$, any clear improvement in the magnetic property is not observed since the relative density becomes 99% or more at a pressure smaller than 500 Kgf/cm2 and effects for realizing other manufacturing conditions are poor. Further, the rising temperature by Joule heat should be kept to a temperature equal to or lower than 750 ° C. If it exceeds 750 ° C., the proper coercive force is lowered extremely by the growth of $R_2Fe(Co)_{14}B$ phase and the plastic deformation of the thin flakes and atomic bonding of the contacting interfaces of the thin flakes have already completed sufficiently therebefore, since the relative density have reached to 99% or more already.

It is sometimes advantageous for improving an assembling property of the rare earth-Fe magnet according to a variety of objects of use to cause an atomic bonding between the thin flakes and a supporting member together with that between the thin flakes.

Hereinafter, the present invention will be explained in detail.

EMBODIMENT 1

Super-rapidly quenched rare earth-Fe thin flakes of an alloy metal composition $Nd_{13}Fe_{83}B_4$ were obtained by the single roll method in Ar atmosphere. This thin flake was analyzed as a super-rapidly quenched rare earth-Fe thin flake in a nonequilibrium state wherein $N2Fe_{14}B$ phases and amorphous phases were coexisting. These thin flakes were filled into a cylindrical cavity of a radius 5 mm formed a pair of electrode punches of WC/Co alloy metal and a die of SiC and a pressure of one axial direction and an electric current were applied to the filled thin flakes in a direction of the height of the cavity at a room temperature and in Ar atmosphere. The pressure was 2 ton/cm$^2$ and the current of 42 KA was supplied for 300 msec with 2 cycles from an instant direct current source wherein discharge was done via thyrister after charging a current into a group of capacitors which was rectified to a predetermined voltage while rising the voltage thereof.

Figure 2A:
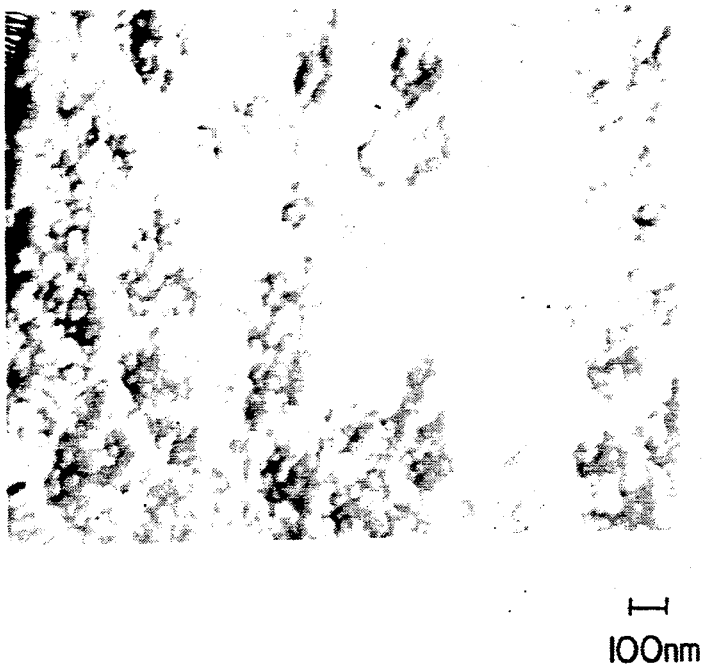
Figure 2B:
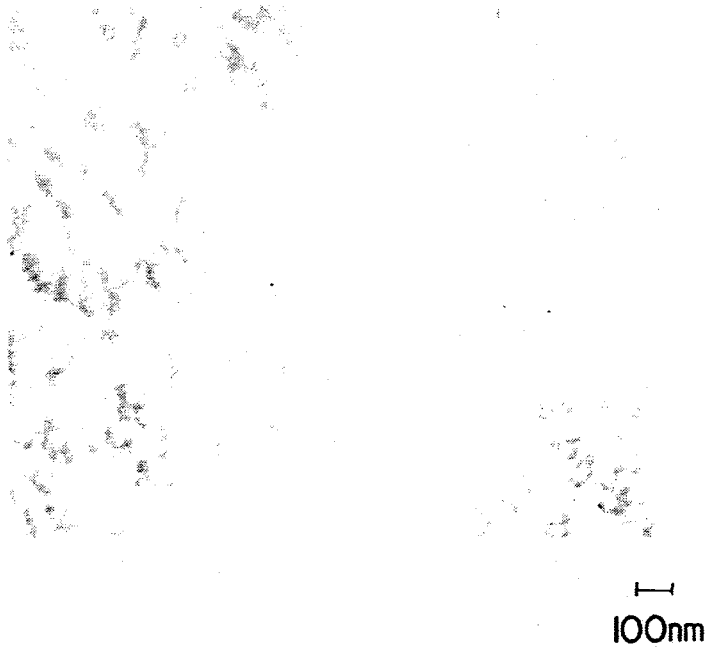

FIG. 1 shows a texture of solidified thin flakes of the rare earth-Fe permanent magnet having been obtained. Further, FIGS. 2(*a*) and 2(*b*) show respective $Nd_2Fe_{12}B$ crystalline particles in the original thin flake and the rare earth-Fe permanent magnet obtained, respectively. As is apparent from the figure, atomic bonding has been caused on respective contact interfaces among the thin flakes and, further, vacant holes were decreased to give a high density of relative density 98.5% since realignment of the thin flakes accompanied with the plastic deformation was accelerated by applying the pressure at this stage. In addition, transition from the nonequilibrium state and generation and/or growth of crystalline particles of $Nd_2Fe_{14}B$ layer were never caused before and after the application of the current since the surfacial layer of the thin flake was quickly cooled by absorbing Joule heat therefrom into the inside of the thin flake.

The above rare earth-Fe permanent magnet exhibited aging properties of Br8KG, $HcB_{6,\ 8}$KOe, Hcj15KOe and (BH)max15MGOe when magnetized by pulses of 50KOe and a high performance as a magnetically isotropic magnet was obtained.

EMBODIMENT 2

Thin flakes of a thickness of about 20 μm was obtained by the super rapid quenching method in which a mother alloy metal of $Nd_{14.0}Co_{7.5}B_{6.0}Fe$ bal melted in Ar atmosphere by the high frequency heating was sprayed onto a roll of Cu rotating at a peripheral velocity of about 50 m/sec. It was confirmed by the X-ray diffraction that the thin flake obtained was a noncrystalline thin flake having been frozen in the melted state as it was. The amorphous thin flakes were ground suitably and particles ground were subjected to a heat treatment at 700° C. in Ar gas atmosphere after they were adjusted to have a particle sizes of 53 to 250 μm. Thereby, super-rapidly quenched rare earth-Fe thin flakes in the nonequilibrium state wherein $Nd_2Fe(Co)_{14}B$ layers and amorphous layer having sizes equal to or smaller than 200 nm were obtained and the thin flakes of about 20 g were filled in a cylindrical cavity of an inner radius of 20 mm. The coercive force Hcj of the thin flake at a room temperature was 16.8 KOe. In this embodiment, the cavity was defined by a pair of electrode punches of graphite and a die of SiC and a pressure of 300 Kgf/cm$^2$ and a vacuum of $10^{-1}$ Torr were maintained in the cavity. Discharge plasma was generated in the cavity by applying a voltage of 30 V having a pulse width of 80 msec between the pair of the electrode punches for an arbitrary time. Thereafter, a current supply of about 7.5 KVA and 2500 A was done for about 95 sec until the temperature was attained to 700° C. while maintaining the pressure between the electrode punches at 300 Kgf/cm$^2$.

The, cylindrical rare earth-Fe permanent magnets of an outer radius of 20 mm having various application times of the pulse voltage were obtained by dismounting from individual cavities after cooling them down to 400° C.

Table 1 shows a relation between the application time of pulse voltage (generation time of discharge plasma) and the aging properties after magnetizing with pulse of 50 KOe.

TABLE 1

| Application time of pulse voltage sec | 0 | 15 | 30 | 60 | 90 | 120 |
|---|---|---|---|---|---|---|
| Hcj, KOe | 8.66 | 14.63 | 15.25 | 18.10 | 17.75 | 17.90 |
| Br, KG | 8.04 | 8.11 | 8.18 | 8.26 | 8.36 | 8.40 |
| (BH)max, MGOe | 13.1 | 14.0 | 14.3 | 15.0 | 15.3 | 15.5 |

As is apparent from Table 1, it is very effective means for improving either of the coercive force Hcj, the residual magnetic flux density Br and the maximum energy product (BH)max to generate the discharge plasma in the cavity by applying a pulse voltage beforehand.

Also, compacting of the collected body in the cavity has been completed within a range from 680° C. to 700° C. and, therefore, the rare earth-Fe permanent magnets of arbitrary shapes can be manufactured very quickly.

EMBODIMENT 3

Super-rapidly quenched rare earth-Fe thin flakes were obtained from mother alloy metals of $Nd_{13.0}B_{6.0}Fe$ bal, $Nd_{12.0}Co_{16.0}B_{8.0}Fe$ bal, $Nd_{14.0}Co_{7.5}B_{6.0}Fe$ bal and $Nd_{14.5}Co_{16.0}B_{5.5}Fe$ bal according to a method similar to that of the Embodiment 2. Every about 5 g of the thin flakes was filled into each of cylindrical cavities of an inner radius of 5 mm same as those of the Embodiment 1 and rare earth-Fe permanent magnets of an outer radius of about 5 mm were obtained according to a method similar to that of the Embodiment 2. In this embodiment, the application time of pulse voltage was kept constant, at 30 sec.

Temperature coefficients of these magnets having been magnetized by 50 KOe pulses were measured by VSM and they are shown in Table 2 in comparison with that of a resin magnet having a relative density of 80%.

TABLE 2

| | ΔBr/Br, %/°C. | ΔHcj/Hcj, %/°C. |
|---|---|---|
| $Nd_{13.0}B_{4.0}Fe$ bal | −0.16 (−1.19) | −0.41 (−0.42) |
| $Nd_{12.0}Co_{16.6}B_{6.0}Fe$ bal | −0.1 | −0.43 |
| $Nd_{14.0}Co_{7.5}B_{6.0}Fe$ bal | −0.09 | −0.39 |
| $Nd_{14.5}Co_{16.0}B_{5.5}Fe$ bal | −0.08 | −0.37 |

Values in brackets () are those of a resin magnet of a relative density of 80%.

As is apparent from Table 2, the temperature coefficient of the coercive force Hcj falls in a range from (−0.37) to (−4.3) without exhibiting any significant change since the high temperature treatment can be completed in a very short time. This indicates that the thermal stability as the permanent magnet is maintains and guaranteed together with that the level of the coercive force Hcj is not decreased so significantly.

EMBODIMENT 4

Ground thin flakes of a coercive force Hcj 16.5 KOe at a room temperature having been obtained from a mother alloy metal of $Nd_{14.0}Co_{7.5}B_{6.0}Fe$ bal used in the Embodiment 2 was classified and sorted and samples each of about 20 g having different particle sizes were prepared.

Next, rare earth-Fe permanent magnets each of about 20 mm outer radius were obtained according to a method similar to that of the Embodiment 2. The application time of pulse voltage was kept constant at 30 sec.

The particle size of each sample, magnetic properties after magnetizing by 50 KOe pulses and the relative density thereof are listed up in Table 3.

TABLE 3

| particle size μm | 32~53 | 53~106 | 106~150 | 150~250 | 250~300 |
|---|---|---|---|---|---|
| relative density % | 97.4 | 99.4 | 99.0 | 98.1 | 93.1 |
| Hcj KOe | 8.4 | 15.5 | 16.7 | 16.1 | 15.2 |
| Br KG | 6.6 | 8.2 | 8.4 | 8.0 | 7.8 |
| (BH)max MGOe | 8.7 | 14.0 | 15.2 | 13.8 | 12.7 |

As is apparent from Table 3, the residual magnetic flux density Br is lowered by the reason that the coercive force Hcj is decreased when the average particle size becomes smaller than 53 μm and by the reason that the relative density is lowered when the particle size becomes larger than 250 μm.

Accordingly, the average particle size is desirably within a range from 53 to 250 μm.

EMBODIMENT 5

Super-rapidly quenched rare earth-Fe thin flakes of a coercive force Hcj 17.0 KOe having been obtained from a mother alloy metal of $Nd_{14.5}Co_{16.0}B_{6.0}Fe$ bal was obtained similarly to the Embodiment 2. Next, ground thin flakes of about 20 g were filled in a cylindrical cavity of an inner radius of about 20 mm. The cavity was formed by a pair of electrode punches and a die same as those of the embodiment 2 and a discharge plasma was generated in the cavity by applying a pressure of 200 $Kgf/cm^2$ and a voltage of 20 V with a pulse width of 120 msec for 30 sec.

Thereafter, a power supply of 2500 A: about 7.5 KVA was executed for about 90 sec while maintaining the pressure between electrode punches at 200 $Kgf/cm^2$ until the temperature of the die was raised up to 700° C. The atmosphere was set constant at an ambient pressure, $10^{-1}$ Torr, $10^{-2}$ Torr, $10^{-3}$ Torr and $10^{-4}$ Torr from the application of pulse voltage to the completion of the power supply.

Table 4 shows magnetic properties of the rare earth-Fe permanent magnets having been magnetized by pulses of 50 KOe which were manufactured under different atmospheres.

TABLE 4

| Atmosphere Torr | ambient pressure | $10^{-1}$ | $10^{-2}$ | $10^{-3}$ | $10^{-4}$ |
|---|---|---|---|---|---|
| Relative density % | 94.7 | 99.2 | 99.0 | 99.3 | 99.2 |
| Hcj KOe | 13.2 | 17.2 | 17.4 | 17.3 | 17.2 |
| Br KG | 7.7 | 8.4 | 8.4 | 8.4 | 8.4 |
| (BH)max MGOe | 12.2 | 15.3 | 15.4 | 15.3 | 15.3 |

As is apparent from Table 4, it is desirable to maintain the atmosphere at a vacuum equal to or lower than $10^{-1}$ Torr from the application of the pulse voltage to the completion of the current supply.

EMBODIMENT 6

Mother alloy metal of $Nd_{14}B_6$ Fe bal was melted in Ar gas atmosphere by the high frequency heating and thin flakes of a thickness 20 to 30 μm having coercive forces Hcj 5 KOe and 8.5 KOe were obtained by spraying the melted alloy metal onto a roll of Cu rotating at a peripheral speed of 50 to 80 m/sec. These thin flakes were conditioned to rare earth-Fe thin flakes having coercive forces Hcj at a room temperature being different from those of the former thin flakes and every 20 g of the latter thin flakes was filled into a cylindrical cavity of an inner radius of about 20 mm. The cavity was formed by the same pair of electrode punches and the die as those in the Embodiment 2 and was maintained at a pressure of 300 $Kgf/cm^2$ and a vacuum of $10^{-1}$ Torr. A voltage of 40 V having a pulse width of 100 msec was applied between the electrode punches for 30 sec and, thereby, a discharge plasma was generated in the cavity.

Thereafter, the pressure between the electrode punches was increased up to 500 $Kgf/cm^2$ and a current of 2500 A was supplied for about 90 sec until temperature of the die reached to 700° C.

Table 5 shows magnetic properties of the former rare earth-Fe thin flakes and the corresponding the permanent magnets having coercive forces at a room temperature different from each other which were measured after magnetizing them by pulses of 50 KOe.

TABLE 5

| HG at a room temperature KOe | 5 | 8.5 | 12.0 | 14.7 |
|---|---|---|---|---|
| Hcj KOe | 7.0 | 12.4 | 13.5 | 14.8 |
| Br KG | 8.3 | 8.6 | 8.5 | 8.5 |
| (BH)max MGOe | 11.0 | 13.4 | 15.4 | 15.6 |

As is apparent form Table 5, it is desirable that the coercive force of the rare earth-Fe thin flakes obtained by the super-rapid quenching method is equal to or higher than 8.0 KOe.

EMBODIMENT 7

Seven kinds of mother metal alloys of $Nd_4B_6Fe$ bal having Nd contents different from each other were melted in Ar gas atmosphere by a high-frequency dielectric heating and thin flakes each having a thickness of about 20 μm were obtained by the super-rapid quenching method wherein each of the melted alloy was sprayed onto a roll of Cu rotating at a peripheral speed of about 50 (M/sec). It was confirmed that the rare earth-Fe thin flakes having different Nd contents were amorphous thin flakes frozen in the melted stated as they were. Next, the rare earth-Fe thin flakes were suitably ground so as for particles having sizes ranging from 50 to 250 μm to occupy 90% or more. Next, they were subjected to a heat treatment at a temperature of 700° C. in Ar gas atmosphere.

Thereby, rare earth-Fe thin flakes in nonequilibrium wherein $Nd_2Fe_{14}B$ phases and amorphous phases having sizes equal to or smaller than 200 nm were coexistent in a randomly gathered state were obtained.

Every 23.5 g of samples of thin flakes having different Nd content according to the super-rapid quenching method was filled into a cylindrical cavity of an inner radius of about 20 mm as a collected body. The cavity was formed by the pair of electrode punches and the die same as those in the Embodiment 2 and was maintained at a pressure of 300 Kgf/cm$^2$ and at a vacuum of $10^{-1}$ Torr using the pair of the electrode punches. A discharge plasma was generated in the cavity by applying a direct current of 40 V having a pulse width of 50 msec for 30 sec. Thereafter, a current of 2500 A (about 7.5 KVA) was applied for about 90 sec while maintaining the pressure of 300 Kgf/cm$^2$ by the pair of the electrode punches until of the pressure axis of the electrode punch could not be observed. A temperature at the stage that the shift of the pressure axis could not be observed was about 680° to 720° C. Next, after cooling down to 400° C., respective contents in the cavities were removed and, thereby, there were obtained rare earth-Fe permanent magnets of an outer radius of about 20 mm having Nd contents different from each other.

Magnetic properties at a room temperature were measured by RFM after magnetizing them by applying pulses of 50 KOe in a direction of the pressure axis of each of the rare earth-Fe permanent magnets having different Nd contents.

Figure 3A:
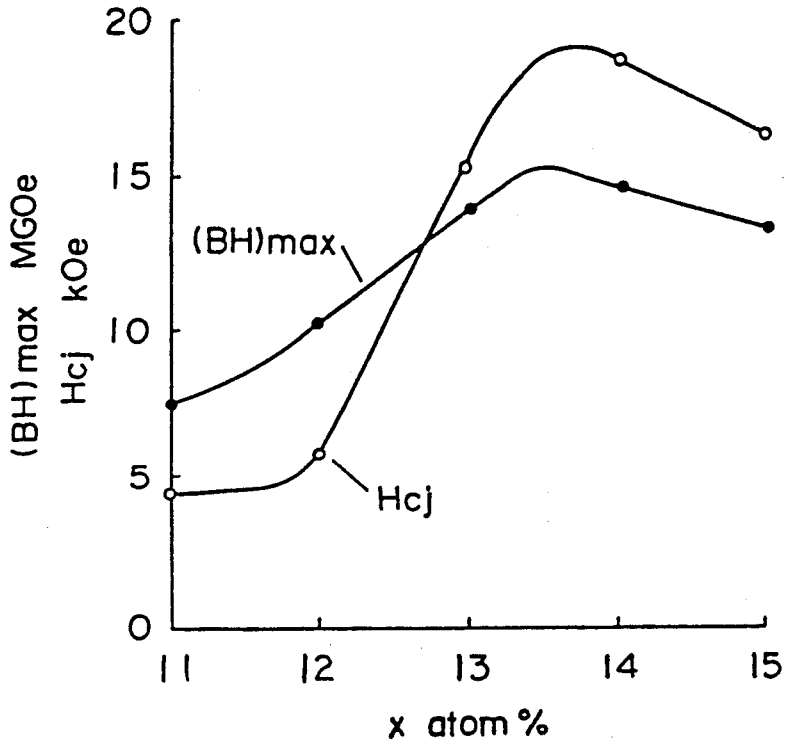
Figure 3B:
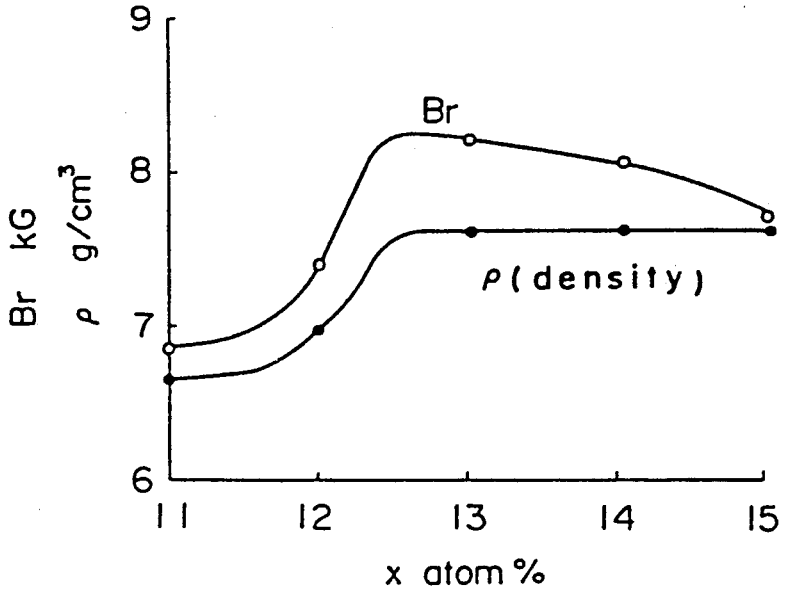

FIG. 3 is a characteristic graph showing a relation of Nd content (atom %), the coercive force Hcj and the residual magnetic flux density Br obtained from the results above mentioned. As is apparent from the figure, both the coercive force Hcj and the residual magnetic flux density Br exhibit maximum values in a range having a lower limit equal to 13 atom % of Nd content and an upper limit lower than 15 atom % of the same, respectively. Especially the residual magnetic flux density Br is about 8.5 KG in the range of Nd content atom % and this supports such a result that the magnetically anisotropic cavity property was highly enhanced in association with the partial plastic deformation of the thin flake. In the meanwhile, the temperature coefficient of the coercive force was measured by VSM with respect to the rare earth-Fe permanent magnets of Nd 13 to 15 atom % after grinding those so as to have an outer radius of 5 mm and took values within a range from −0.38° to −0.40/° C.

EMBODIMENT 8

Nd of a purity of 97 wt % (the balance being other rare earth elements including Co and Pr as main elements), ferro boron (purity of boron about 20 wt %) and electrolyte iron were prepared and melted in Ar gas atmosphere by the high frequency heating so as to have a composition of Nd 29 wt %, B 1 wt % and Fe bal. Thus, an alloy metal ingot was obtained. The alloy metal ingot was melted in Ar gas atmosphere by the high-frequency heating and the melted alloy metal was sprayed onto a roll of Cu rotating at a peripheral speed about 50 m/sec and a ribbon having a thickness of about 40 μm was obtained by the short roll method.

This ribbon was confirmed by the X-ray diffraction that it was an amorphous ribbon wherein the melted state was frozen as it was. $Nd_2Fe_{14}B$ phases were precipitated by hot-rolling the noncrystalline ribbon and, thereby, the thickness of the ribbon was reduced to about 20 μm. It was confirmed by X-ray diffraction that C axis of $Nd_2Fe_{14}B$ phase precipitated was oriented in a direction perpendicular to the hot rolling surface. Namely, the ribbon was a rare earth-Fe magnetic anisotropic strip wherein $Nd_2Fe_{14}B$ phases and amorphous phases being equal to or smaller than 400 nm were coexistent.

Next, particles obtained were filled into a cavity formed by a die of SiC and punches of black lead and a current superposed with a direct current and an alternating current of 1 KHz at a ratio 5:4 was supplied for 30 sec while applying a pressure of one axis of 10 Kgf/cm$^2$ at first and 300 Kgf/cm$^2$ after 5 seconds between the punches. This magnet had a relative density of 99.6% and magnetic properties thereof were the residual magnetic flux density Br of 10.8 KG and the coercive force Hcj of 13 KOe.

In this magnet, a nonequilibrium state wherein $Nd_2Fe_{14}B$ phases and amorphous phases of sizes being smaller than 500 nm were coexistent.

EMBODIMENT 9

Nd of a purity of 97 wt % (the balance being other rare earth elements including Ce and Pr as main elements), ferro boron (purity of boron about 20 wt %) and electrolyte iron were prepared and a mother alloy metal was obtained by melting them in Ar gas atmosphere using the high-frequency heating so as to have a composition of Nd 29 wt %, B 1 wt % and Fe bal. Next, the mother alloy metal was melted in Ar gas atmosphere by the high-frequency heating and was sprayed onto a roll of Cu rotating at a peripheral speed of about 50 m/sec.

A ribbon of a thickness of 40 μm was obtained by the single roll method. This ribbon was conformed by X-ray diffraction as an amorphous ribbon which was frozen in the melted state. The amorphous ribbon was subjected to a heat treatment at 700° C. in Ar gas atmosphere and was conditioned into a rare earth-Fe strip in a nonequilibrium state wherein $R_2Fe_{14}B$ phases and amorphous phases of sizes smaller than 200 nm were coexistent in a isometrically gathered state.

Figure 4:
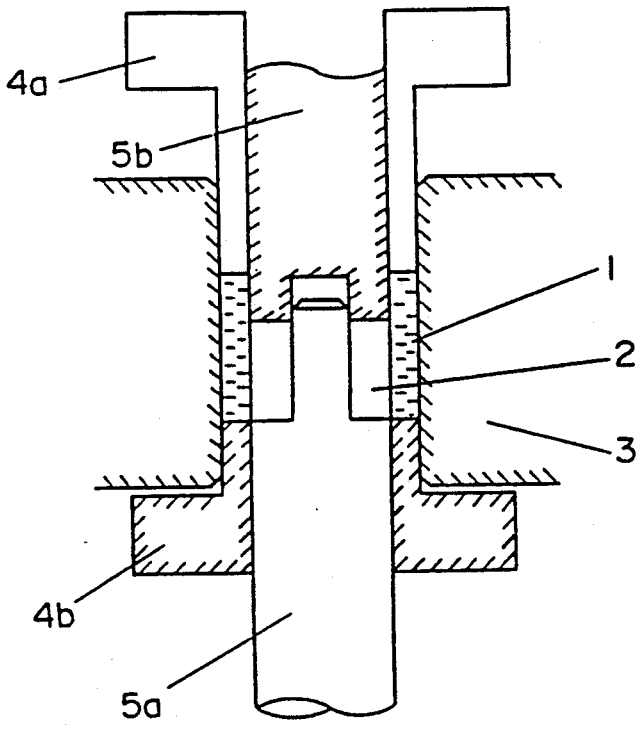
FIG. 4 is a sectional view of a main part showing a composition of dies for molding a permanent magnet.

This strip was filled in a cavity of molding dies comprised of an electrically insulating molding member, an electrically conductive molding member and an electrically conductive support member as shown in FIG. 4.

In FIG. 4, "1" indicates a solidified body of super-rapidly quenched rare earth-Fe thin flakes wherein $R_2Fe_{14}B$ phases and amorphous phases were coexistent "2" indicates a support member of Fe, "3" indicates a die of SiC, "4*a*" indicates a punch of SiC WC/Co, "4*b*" indicates a punch of SiC, "5*a*" is a center core of a Ni base heat resistive alloy metal and "5*b*" indicates a center core of SiC.

Next, a current of 650 A was supplied to the conductive molding member for 10 sec while applying a pressure of 30 Kgf/cm$^2$ to the R-Fe-B thin flake collected body via the punches 4*a* nd 4*b*. Next, there was obtained a structural body of permanent magnet formed as one piece from the permanent magnetic member of 8 mm outer radius and 4 mm height and the conductive support member by removing it from the mold.

The permanent magnetic portion of the structural body of permanent magnet had a relative density of 98.6% and was jointed to the conductive support member strongly.

Magnetic properties of the permanent magnetic portion cut out from the structural body of permanent magnet were measured by VSM after magnetizing the same by applying pulses of 5 KOe in the radial direction thereof and were (BH)max 12.3 MGOe, Br 7.96 KG and Hcj 13.2 KOe.

In order for comparison, a ring-like resin magnet of 8 mm outer radius and 4 mm height was prepared by injection molding Sm-Co resin magnetic material of injection mold grade in a radial magnetic field generated by a repulsive magnetomotive force of 40000 AT which was obtained by mixing 92 wt% of $Sm(Co_{0.66-8}Cu_{0.101}Fe_{0.214}Zr_{0.017})_7$ particles of Hcj 9.8 KOe and 8 wt% of 12-polyamide of a relative viscosity 1.6 (obtained by measuring 0.5% m-cresol solvent at 25° C. using Ostward viscometer). After magnetizing by pulses of 45 KOe in the radial direction thereof, magnetic properties were measured. They exhibited merely (BH)max 3.7 MGOe, Br 4.1 KG and Hcj 9.8 KOe.

INDUSTRIAL APPLICABILITY

As mentioned in detail, the present invention has very high industrial values since sintered bodies of a high density can be obtained by applying a pressure of one axis and a current to collected body of Fe-B-R thin flakes in a nonequilibrium state.

Especially, it becomes possible to provide permanent magnets having a residual magnetic flux density Br higher than 9 KG and a coercive force Hcj higher than 8 KOe or 15 KOe while guaranteeing excellent capability for forming arbitrary shapes and productivity thereby.

We claim:

1. A method for manufacturing permanent magnets comprising the steps of:

subjecting a gathered body of thin flakes of a rare earth-Fe-B alloy metal to a discharge electric field, said thin flakes being comprised of an R-Fe-B alloy metal, an R-Fe-B-M alloy metal; an R-Fe(Co)-B alloy metal comprising 11 to 18 atom % R, 4 to 11 atom % B, 30 atom % Co, the balance being Fe; and/or an R-Fe(Co)-M-B alloy metal; wherein R is one or more rare earth elements and M is one or more members selected from the group consisting of Si, Al, Nb, Zr, Hf, Mo, Ga, P and C, and wherein said thin flakes are in a nonequilibrium state such that the $R_2Fe_{14}B$ phases and amorphous phases are coexistent;

generating Joule heat on contacting interfaces of said thin flakes by applying pressure to said gathered body of said thin flakes and by supplying a current thereto, and bonding said gathered body integrally by making said thin flakes deform plastically in a warm state.

2. The method for manufacturing permanent magnets as claimed in claim 1 wherein an average particle size of said thin flakes is of 53 to 250 μm.

3. The method for manufacturing permanent magnets as claimed in claim 1, in which a size of the $R_2Fe_{14}B$ phase of said thin flakes is of 40 to 400 nm.

4. The method for manufacturing permanent magnets as claimed in claim 1 wherein said discharge electric field is a direct current voltage and/or an alternating current voltage of a low frequency ($0<\omega<<\omega pi$ wherein $\omega$ is a frequency of said AC voltage and $\omega pi$ is an oscillation frequency of ion plasma).

5. The method for manufacturing permanent magnets as claimed in claim 1 wherein said discharge electric field and the application of said pressure and said current are done in an atmosphere of a vacuum equal to or lower than $10^{-1}$ Torr.

6. The method for manufacturing permanent magnets as claimed in claim 1 wherein said pressure is larger than 200 $Kgf/cm^2$.

7. The method for manufacturing permanent magnets as claimed in claim 1 further including the step of magnetizing said thin flakes anisotropically by a warm plastic deformation.

8. The method for manufacturing permanent magnets as claimed in claim 1 wherein the warm plastic deformation of said gathered body of said thin flakes and said bonding between said contact interfaces of said thin flakes are performed at a temperature lower than 750° C.

9. The method for manufacturing permanent magnets as claimed in claim 1 wherein bonding between said thin flakes and a support member is done at the same time of said bonding between said contacting interfaces of said thin flakes.

* * * * *